US008870324B2

(12) United States Patent
Buschmann

(10) Patent No.: US 8,870,324 B2
(45) Date of Patent: Oct. 28, 2014

(54) METHOD TO EXECUTE A PRINT INTERRUPTION IN PRINTING OPERATION OF AN INK PRINTING SYSTEM WITH AT LEAST ONE PRINTING APPARATUS

(71) Applicant: Stefan Buschmann, Arenshausen (DE)

(72) Inventor: Stefan Buschmann, Arenshausen (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 13/973,380

(22) Filed: Aug. 22, 2013

(65) Prior Publication Data

US 2014/0055515 A1 Feb. 27, 2014

(30) Foreign Application Priority Data

Aug. 23, 2012 (DE) ..... 10 2012 107 776

(51) Int. Cl.
*B41J 29/38* (2006.01)

(52) U.S. Cl.
CPC ..... *B41J 29/38* (2013.01)
USPC ..... 347/14; 347/10; 347/19; 347/60

(58) Field of Classification Search
CPC ..... B41J 29/38; B41J 19/205; B41J 11/51; B41J 11/425; B41J 15/18; B41J 15/20; B41J 15/22; B41J 15/24
USPC ..... 347/10, 11, 14, 16, 19, 57, 60
See application file for complete search history.

(56) References Cited

U.S. PATENT DOCUMENTS

| | | | | |
|---|---|---|---|---|
| 7,334,858 | B2 * | 2/2008 | Kogure et al. | 347/16 |
| 2009/0160887 | A1 | 6/2009 | Hamazaki et al. | |
| 2012/0182343 | A1 | 7/2012 | Biglari | |

FOREIGN PATENT DOCUMENTS

| | | |
|---|---|---|
| DE | 102011000174 | 7/2012 |
| EP | 1795356 | 6/2007 |

* cited by examiner

*Primary Examiner* — Thinh Nguyen
(74) *Attorney, Agent, or Firm* — Schiff Hardin LLP

(57) ABSTRACT

In a method to execute a print interruption, a printing substrate is printed to with a printing unit with at least one print head. With aid of a sensor, print clock pulses are generated that are supplied to a print controller depending on a feed of the printing substrate. With triggering of the print interruption, a feed speed of the printing substrate is reduced from a print speed in the printing operation to a predetermined speed according to a deceleration ramp. After the print interruption the printing substrate is accelerated again to the print speed according to an acceleration ramp. Given occurrence of a print clock pulse during at least one of the ramps, the print controller sends at least one vibration pulse to the at least one print head so that at least one cycle of vibration oscillations is implemented at the print head. The at least one vibration pulse is generated if a time interval of the print clock pulses relative to one another reaches a predetermined value.

4 Claims, 3 Drawing Sheets

METHOD TO EXECUTE A PRINT INTERRUPTION IN PRINTING OPERATION OF AN INK PRINTING SYSTEM WITH AT LEAST ONE PRINTING APPARATUS

BACKGROUND

Ink printing apparatuses can be used for single-color or multicolor printing to a printing substrate (for example a single sheet or a web-shaped recording medium) made of the most varied materials (paper, for example). The design of such ink printing apparatuses is known; see for example EP 0 788 882 B1. Ink printing apparatuses that operate according to the Drop on Demand (DoD) principle have a print head or multiple print heads with nozzles comprising ink channels, the activators of which nozzles—controlled by a print controller—excite ink droplets in the direction of the printing substrate, which ink droplets are directed towards the printing substrate in order to apply print dots there for a print image. The activators can generate ink droplets piezoelectrically (DE 697 36 991 T2).

In an ink printing apparatus, the ink that is used is adapted in terms of its physical/chemical composition to the print head; for example the ink is adapted with regard to its viscosity. Given low printer utilization, in the printing process not all nozzles of the print head are activated. Many nozzles have downtimes, with the consequence that the ink in the ink channel of these nozzles is not moved. Due to the effect of the evaporation out of the nozzle opening, the danger exists that the viscosity of the ink then changes. This has the result that the ink in the ink channel can no longer move optimally and exit from the nozzle. In extreme cases, the ink in the ink channel dries up completely and blocks the ink channel, such that a printing with this nozzle is no longer possible.

A drying of the ink in the nozzles of a print head during their print pause represents a problem that can be prevented in that a flushing medium (for example ink or cleaning fluid) is flushed through all nozzles within a predetermined cycle. This flushing cycle can be set corresponding to the print utilization.

Furthermore, from DE 697 36 991 T2 (EP 0 788 882 B1) it is known to remedy difficulties caused by the change of the viscosity of the ink in the nozzles upon the ejection of ink droplets in that the piezoelectric activators of the nozzles are respectively vibrated before or after the printing process (also called prefire or meniscus vibrations), such that no ink droplets are ejected but the ink in the nozzles is stirred. It can thereby be achieved that the ink situated at the nozzle openings mixes with the ink located inside the piezoelectric activator, such that the ink droplets can be generated again under normal conditions in the printing operation.

In the printing of a printing substrate it is sometimes necessary to monitor briefly during an interrupt the printing operation (for example for 3 min), for example in order to monitor the register quality after proofing a print job or in order to correct problems in the post-processing of the printing substrate. The feed speed of the printing substrate can thereby be reduced up to a complete stop in a deceleration ramp and can be accelerated again in an acceleration ramp after a wait time (of 3 min, for example). During the slowing time period of the printing substrate before the print interruption and the acceleration of the printing substrate after the print interruption, printing can be continued, wherein the time intervals between the print dock pulses (and therefore between the emissions of ink droplets) increase or decrease during the ramps. During the duration of the ramps, the problem of ink drying out in the nozzles of the print heads is then intensified, with the consequence that printing can no longer be conducted sufficiently well.

SUMMARY

It is an object to specify a method that ensures that, before and after a print interruption in which the printing substrate is braked from a printing speed to a standstill and is subsequently accelerated to printing speed again in ramps, and in which printing is continued during the ramps, a change of the viscosity of the ink in the nozzles of a print head (in particular at the nozzle openings) that prevents the ejection of ink droplets after the end of the interruption is avoided.

In a method to execute a print interruption, a printing substrate is printed to with a printing unit with at least one print head. With aid of a sensor, print clock pulses are generated that are supplied to a print controller depending on a feed of the printing substrate. With triggering of the print interruption, a feed speed of the printing substrate is reduced from a print speed in the printing operation to a predetermined speed according to a deceleration ramp. After the print interruption the printing substrate is accelerated again to the print speed according to an acceleration ramp. Given occurrence of a print clock pulse during at least one of the ramps, the print controller sends at least one vibration pulse to the at least one print head so that at least one cycle of vibration oscillations is implemented at the print head. The at least one vibration pulse is generated if a time interval of the print clock pulses relative to one another reaches a predetermined value.

DESCRIPTION OF EXEMPLARY EMBODIMENTS

Figure 1:
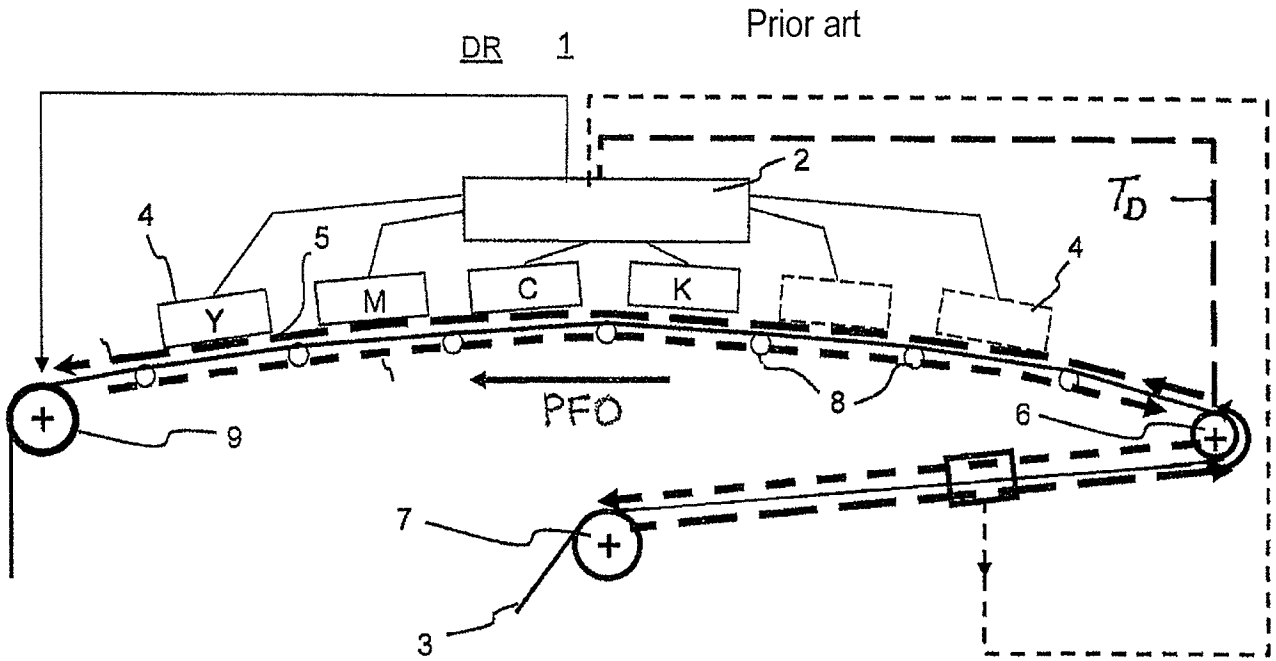
FIG. 1 is a representation of a printing unit of an ink printing apparatus (prior art)

For the purposes of promoting an understanding of the principles of the invention, reference will now be made to preferred exemplary embodiments/best mode illustrated in the drawings and specific language will be used to describe the same. It will nevertheless be understood that no limitation of the scope of the invention is thereby intended, and such alterations and further modifications in the illustrated embodiments and such further applications of the principles of the invention as illustrated as would normally occur to one skilled in the art to which the invention relates are included herein.

In the method of an exemplary embodiment, before and after a print interruption the feed speed of the printing substrate is braked from the speed in the printing operation (print speed) to a predetermined speed or to a standstill, and is accelerated to print speed again after the end of the print interruption. Printing clock pulses are generated with a sensor (for example with an encoder roller driven by the printing substrate) depending on the feed of the printing substrate, which printing clock pulses are supplied to a print controller. Given the occurrence of a printing clock pulse, the print controller can send at least one vibration pulse to the print heads before a print-start signal for print heads for which print data are present, based on which vibration pulse the print heads execute a vibration cycle made up of vibration oscillations. The vibration pulses can also be triggered only for a time portion of the ramps, for example if the speed of the printing substrate is less than half of the print speed. Depending on the time interval of the printing clock pulses, a vibration cycle or multiple vibration cycles can be triggered.

The method according to an exemplary embodiment thereby has the following advantages:

- The reliability of the printing during the ramps—i.e. the slowing and acceleration phases—is increased; no data loss occurs.
- Printing with ink that dries quickly is possible during the ramps.

The exemplary embodiment can be realized at low cost.

Figure 2:
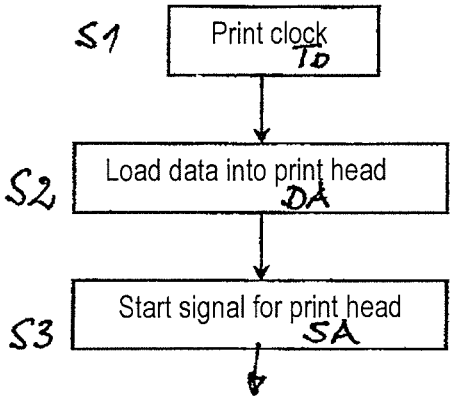
FIG. 2 is a representation of a workflow diagram for the control of the print heads.
Figure 3:
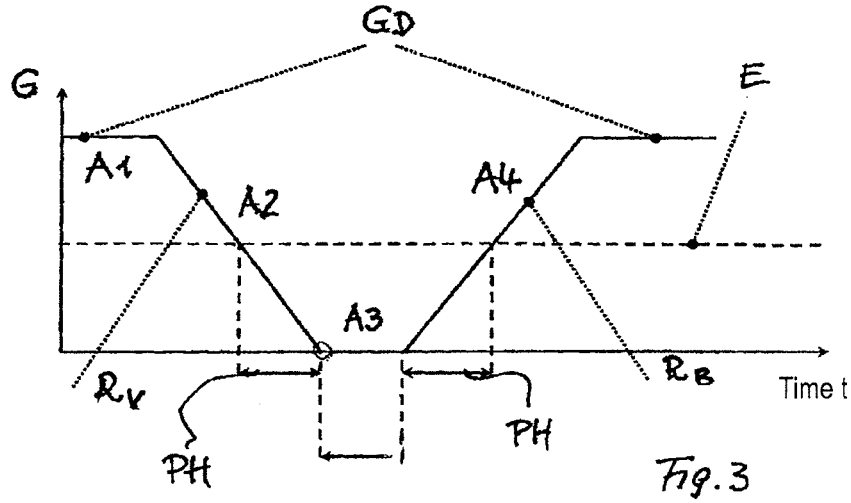
FIG. 3 is a representation of the feed speed of the printing substrate web before and after a print interruption.

An exemplary embodiment is explained further using FIGS. 1 through 3.

The aforementioned problems given a print interruption are explained further using FIG. 1. A printing substrate web 3 is thereby used as a printing substrate, without the exemplary embodiment thereby being limited to a printing substrate web. In addition to this, in the exemplary embodiment it is assumed that the printing unit has a plurality of print heads. However, the statements also apply if the printing unit provides only one print head.

A printing unit 1 and a print controller 2 of a printing apparatus DR are shown. The printing unit 1 is arranged along a printing substrate web 3, which printing unit 1 has print bars 4 with print heads 5 in series as viewed in the transport direction PF0 of the printing substrate web 3. Given color printing, for example, a respective print bar 4 can be provided per color to be printed. The printing substrate web 3 is moved past the print bars 4 with the aid of a take-up roller 9; it thereby lies on a saddle with guide rollers 8. A sensor is arranged at the intake of the printing unit 1, which sensor generates print clock pulses TD depending on the feed speed of the printing substrate web 3, which print clock pulses TD are supplied to the print controller 2 and are used by the print controller 2 to—for example—establish the point in time of the ejection of ink droplets at the nozzles of the individual print heads 5 when print data for printing are already present in the print controller 2. The sensor can, for example, be executed as a rotary encoder or encoder roller 6 which is driven by the printing substrate web 3.

According to FIG. 2, print clock pulses TD are generated by the encoder roller 6 synchronously with the feed of the printing substrate web 3 (Step S1), which means that one print clock pulse TD is emitted by the encoder roller 6 to the print controller 2 per pixel of a character to be printed, for example. After every print clock pulse TD, the print controller supplies print data DA to the respective print head 5 (FIG. 2, Step S2) and then triggers the emission of ink droplets via a print-start signal SA (FIG. 2, Step S3). The print heads 2 (in a known manner) have nozzles with ink channels that, for example, can generate ink droplets with a piezoelectric activator according to the DoD principle, which ink droplets are directed towards the printing substrate web 3 in order to generate a print dot there. The printing substrate web 3 is thereby supplied to the encoder roller 6 via a drive roller 7 arranged before said encoder roller 6.

If the printing operation is interrupted, the problems illustrated above occur during the slowing phase and acceleration phase.

In both cases, during these phases the printing substrate web 3 moves, with the consequence that the encoder roller 6 emits print clock pulses TD. Print-start signals SA are then supplied to the print heads 5 for which print data DA exist, such that these eject ink droplets onto the printing substrate web 3 in continued printing. However, since the time interval between the print clock pulses TD in the phase in which the printing substrate web 3 is slowed is always greater in comparison the printing operation, the danger exists that the viscosity of the ink in the nozzle openings has changed gradually, such that ink droplets cannot be generated properly by the piezoelectric activators. The time interval of the print clock pulses TD accordingly decreases during the acceleration phase so that the viscosity of the ink can be changed at the beginning of the acceleration after the print interruption such that the ejection of ink droplets from the print heads is disrupted.

The curve of the velocity G of the printing substrate web 3 is plotted over time t in a print interruption using FIG. 3. The printing substrate web 3 with print speed GD is transported (Segment A1) until a print interruption should be triggered. The printing substrate web 3 is subsequently braked and brought to a standstill in a deceleration ramp RV (Segment A2). After the print interruption (Segment A3), the printing substrate web 3 is accelerated from the standstill to the print speed GD again in an acceleration ramp RB (Segment A4).

Figure 4A:
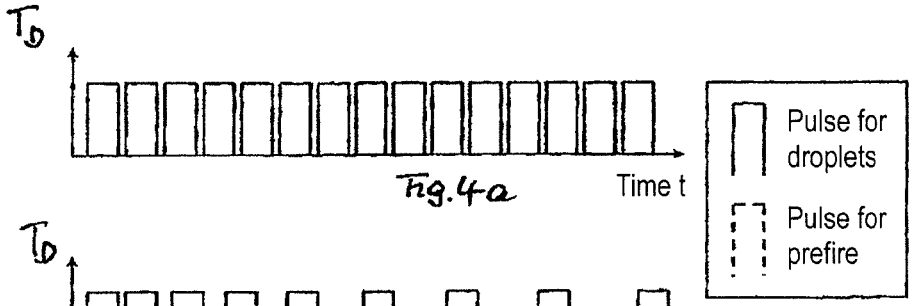
FIGS. 4*a* through 4*c* are pulse diagrams that present a series of print clock pulses during the printing operation and before a print interruption, with and without introduction of vibration cycles.
Figure 4B:
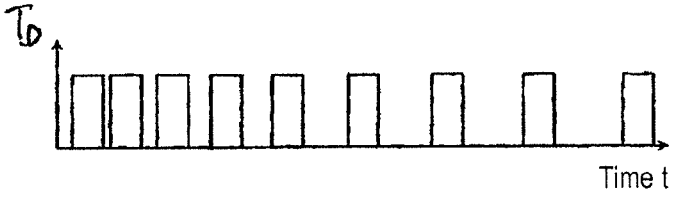
Figure 4C:
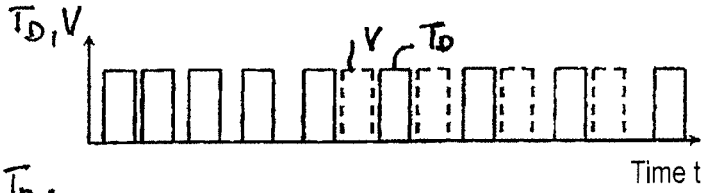
Figure 5A:
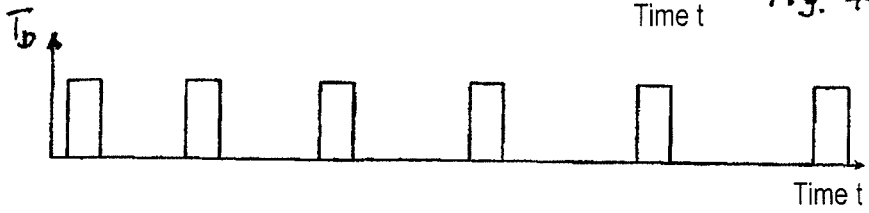
FIGS. 5*a* and 5*b* are pulse diagrams that present a series of print clock pulses before a printing operation, with and without introduction of vibration cycles.
Figure 5B:
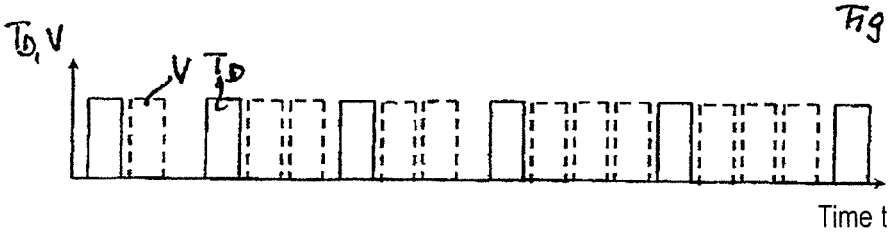

FIG. 4*a* shows a series of print clock pulses TD at print speed GD, plotted over time t (Segment A1, FIG. 3). At each print clock pulse TD, given the presence of print data DA ink droplets can be ejected from print heads 5 towards the printing substrate web 3. FIG. 4*b* shows the sequence of print dock pulses TD during the deceleration ramp RV (Segment A2, FIG. 3). The time interval of the print clock pulses TD increases. From FIG. 4*c* it can be learned how vibration pulses V (shown in dashed lines) can be generated between the print dock pulses TD and be supplied to the print heads 5. Via the vibration pulses V, vibration cycles with a predetermined number of vibration oscillations can be triggered in a known manner at the print heads 5. If the time interval of the print clock pulses TD before and after the print interruption allows it (example FIG. 5*a*), multiple vibration cycles can also be triggered between the print clock pulses TD, for example two or three vibration cycles (FIG. 5*b*).

FIG. 4 shows the relationships during the deceleration ramp RV. The relationships during the acceleration ramp RB are reversed in comparison to FIG. 4. Here the time intervals between the print clock pulses TD are increasingly shorter, depending on the speed G of the printing substrate web 3.

Since a plurality of vibration oscillations are executed in one vibration cycle, a vibration cycle between the print clock pulses TD can only be implemented when its time interval allows this. Whether this is possible depends on the print speed GD. For example, at a high print speed GD the triggering of a vibration cycle can only be reasonable if the speed of the printing substrate web 3 has already been partially reduced and the time interval of the print clock pulses TD has reached a predetermined value, for example if the speed of the printing substrate web 3 has dropped to half of the print speed GD or if the printing substrate web 3 has not yet reached half of the print speed GD in the acceleration ramp RB (Level E, FIG. 3; Phases PH), for example.

If the printing substrate web 3 is slowed or accelerated in a ramp R, the encoder roller 6 generates additional print clock pulses TD so that the print heads continue to print given the presence of print data DA. A sequence of print clock pulses TD during the braking phase RB is shown in principle from FIG. 4*b*. Since the time interval between the individual print clock pulses TD is greater in comparison to the printing operation (FIG. 4*a*), the danger explained above exists that the ejection of ink droplets is incorrect due to a change of the viscosity at the nozzle openings. In order to avoid this problem, according to the exemplary embodiment at least one vibration cycle is triggered via a vibration pulse V between the print clock pulses TD, meaning that the activator generates vibrations at the end of the nozzle in a respective ink channel in order to stir the ink there (in particular at the nozzle opening) before the next print-start signal SA is triggered. Whenever the encoder roller 6 generates a print clock pulse TD, at least one vibration pulse V can be passed to the activator of the print head 5 that is ready to print or to all print heads 5, based on which vibration pulse V at least one vibration cycle made up of vibrations is generated in the nozzles in order to stir the ink.

Although preferred exemplary embodiments are shown and described in detail in the drawings and in the preceding specification, they should be viewed as purely exemplary and not as limiting the invention. It is noted that only preferred exemplary embodiments are shown and described, and all variations and modifications that presently or in the future lie within the protective scope of the invention should be protected.

I claim as my invention:

1. A method to execute a print interruption in a printing operation of an ink printing system with at least one printing apparatus wherein a printing substrate is printed to with a printing unit with at least one print head, comprising the steps of:

with aid of a sensor, generating print clock pulses that are supplied to a print controller depending on a feed of the printing substrate;

with triggering of the print interruption, reducing a feed speed of the printing substrate from a print speed in the printing operation to a predetermined speed according to a deceleration ramp, and after the print interruption accelerating the printing substrate again to the print speed according to an acceleration ramp;

given occurrence of a print clock pulse during at least one of the ramps, sending with the print controller at least one vibration pulse to the at least one print head so that at least one cycle of vibration oscillations is implemented at said print head; and generating the at least one vibration pulse if a time interval of the print clock pulses relative to one another reaches a predetermined value.

2. The method according to claim 1 in which a first vibration pulse is generated only when the feed speed of the printing substrate is less than half of the print speed.

3. The method according to claim 1 in which the printing unit has a plurality of print heads, a print-start signal is supplied to the print heads for which print data exist in the print controller given occurrence of print clock pulses during at least one of the ramps, based on the print-start signal the activated print heads ejecting ink droplets, and after a print clock pulse, at least one vibration pulse being sent to the print heads before a next print clock pulse is generated by the sensor.

4. A method to execute a print interruption in a printing operation of an ink printing system with at least one printing apparatus wherein a printing substrate is printed to with a printing unit with at least one print head, comprising the steps of:

with aid of a sensor, generating print clock pulses that are supplied to a print controller depending on a feed of the printing substrate;

with triggering of the print interruption, reducing a feed speed of the printing substrate from a print speed in the printing operation to a predetermined speed according to a deceleration ramp, and after the print interruption accelerating the printing substrate again to the print speed according to an acceleration ramp;

given occurrence of a print clock pulse during each of the ramps, sending with the print controller at least one respective vibration pulse to the at least one print head so that at least one cycle of vibration oscillations is implemented during each of the ramps at said print head; and generating the at least one respective vibration pulse if a time interval of the print clock pulses relative to one another reaches a predetermined value.

* * * * *